US005216337A

United States Patent [19]

Orton et al.

[11] Patent Number: 5,216,337

[45] Date of Patent: Jun. 1, 1993

[54] RADIO CONTROLLED SPEED CONTROLLER WITH AUDIBLE FEEDBACK SIGNAL

[76] Inventors: Kevin R. Orton, 970 Calle Negocio, San Clemente, Calif. 92672; Noel W. Lovisa, 26 Buna Avenue, Mundingburra 4810, Townsville, State of Queenland, Australia

[21] Appl. No.: 948,661

[22] Filed: Sep. 22, 1992

Related U.S. Application Data

[63] Continuation-in-part of Ser. No. 783,279, Oct. 28, 1991.

[51] Int. Cl.[5] ..... H02P 7/00

[52] U.S. Cl. ..... 318/16; 446/456; 318/490

[58] Field of Search ..... 446/454, 456, 225; 318/16, 581, 490; 116/37.23, 62.4, 140, 142 R, DIG. 44; 340/870.3, 446, 474, 825.25, 825.45, 825.48, 825.69; 388/804, 805, 829, 831, 832, 909

[56] References Cited

U.S. PATENT DOCUMENTS

| | | | |
|---|---|---|---|
| 4,160,253 | 7/1979 | Mabuchi et al. | 318/16 X |
| 4,189,706 | 2/1980 | Knox | 116/37 X |
| 4,360,808 | 11/1982 | Smith, III et al. | 318/16 X |
| 4,413,253 | 11/1983 | Hofer et al. | 116/142 R |
| 4,584,504 | 4/1986 | Lee et al. | 340/825.69 |
| 4,946,415 | 8/1990 | Huang | 446/225 |
| 4,964,331 | 10/1990 | Halery et al. | 116/23 X |
| 5,113,427 | 5/1992 | Ryoichi et al. | 340/825.48 |
| 5,136,452 | 8/1992 | Orton | 318/16 X |

*Primary Examiner*—Jonathan Wysocki

*Attorney, Agent, or Firm*—Loyal M. Hanson

[57] ABSTRACT

A speed controller with an audible feedback signal capability includes a receiver line, first and second battery lines, and a motor line. A drive circuit is provided for switching between an ON state coupling the first battery line to the motor line and an OFF state decoupling the first battery line from the motor line. Microprocessor circuitry for switches the drive circuit between the ON state and the OFF state according to setpoint information received by the control circuit from a receiver connected to the receiver line. The microprocessor circuitry is programmed to produce an audible feedback signal without a conventional acoustical transducer by cycling the drive circuit between the ON state and the OFF state at an audible rate for a controlled period of time at a duty ratio sufficiently small to avoid normal motor operation so that current flowing from the battery during the ON state causes audibly discernible mechanical vibration of at least one of the drive circuit, battery componentry connected to the first and second battery lines, and motor componentry connected to the motor line. The microprocessor circuitry may also turn a brake circuit on in order to insure a path for current to flow apart from the motor. In line with the above, a method of producing an audible signal for speed controller feedback purposes includes the step of providing a speed controller having a drive circuit as just described. The method proceeds by cycling the drive circuit between the ON state and the OFF state at an audible rate for a controlled period of time at a sufficiently small duty ratio.

8 Claims, 3 Drawing Sheets

RADIO CONTROLLED SPEED CONTROLLER WITH AUDIBLE FEEDBACK SIGNAL

CROSS REFERENCE TO RELATED APPLICATION

This application is a continuation in part of U.S. patent application Ser. No. 783,279 filed Oct. 28, 1991.

BACKGROUND OF THE INVENTION

1. Technical Field

This invention relates generally to radio controlled (R/C) models, and more particularly to an R/C speed controller with an audible feedback signal.

2. Background Information

Recall that the drive motor of a radio controlled model operates under control of an onboard control module called an R/C speed controller . . . or just speed controller. The speed controller includes circuitry that controls the drive motor according to setpoint information received by a miniature onboard receiver. The R/C enthusiast manipulates a throttle trigger on a handheld transmitter to produce the setpoint information, the transmitter communicates it to the speed controller via the onboard receiver, and the speed controller controls the drive motor accordingly.

To calibrate some existing speed controllers and fine tune operation for maximum racing performance, the operator adjusts various potentiometers on the speed controller. One potentiometer calibrates the speed controller to the setpoint representing zero motor speed. Another calibrates it to the setpoint representing maximum motor speed. A third, sets a limit on the maximum drive current the motor can draw. Other such setup adjustments may be involved, and the operator must often use separate metering instruments. So, the tuning procedure (i.e., speed controller setup) can be somewhat tedious and not easily repeated from one race to the next.

U.S. patent application Ser. No. 783,279 (the parent application) facilitates setup by providing microprocessor circuitry and a miniature keypad on the speed controller. The microprocessor responds to keypad entries by making desired setup adjustments. As a result, the operator can enter operating parameters directly, and even store and recall information as desired, all without potentiometers, test points, and separate metering instruments.

Preferably, the microprocessor circuitry includes means for producing an audible feedback signal in order to indicate when a keypad entry has been successfully made or a desired operation fully performed. But that requirement introduces certain problems. Buzzers, piezoelectric devices, and other existing electrical-to-acoustical transducers require too much additional space in an already fully packed, miniaturized, speed control module. Furthermore, they introduce undesirable weight and cost. Thus, R/C speed controllers need a better way to produce an audible feedback signal.

SUMMARY OF THE INVENTION

This invention solves the problems outlined above by cycling drive current on and off at an audible rate (e.g., 300–5000 KHz) for a controlled period of time. Doing so causes audibly discernible mechanical vibration of the motor armature and windings, the battery pack wiring, and/or speed controller wiring. Those vibrations produce the desired feedback signal. Thus, the invention communicates audibly with the operator while avoiding the space, weight, and cost of conventional transducer componentry.

To produce audibly discernible mechanical vibrations requires sufficient battery capacity (e.g., 30–50 ampere pulses). Existing nicad R/C battery packs have the surge capacity required. In addition, wiring resistance must be sufficiently small to permit high current flow. Furthermore, the speed controller must employ switching componentry capable of switching current on and off sufficiently fast (e.g., on the order of one hundred microseconds).

In terms of the claim language subsequently developed, a speed controller constructed according to the invention includes a it includes a receiver line for connection to a control-signal output of a receiver, first and second battery lines for connection to first and second terminals of a battery, and at least one motor line for connection to a first terminal of a motor. A second terminal of the motor connects to the second terminal of the battery (sometimes via the second battery line). Those lines are electrically conductive lines, and they may include circuitboard traces, wiring, connectors, and terminals.

The speed controller also includes a drive circuit. It serves the function of switching between an ON state in which the drive circuit couples the first battery line to the motor line and an OFF state in which the drive circuit decouples the first battery line from the motor line. Microprocessor circuitry is provided for switching the drive circuit between the ON state and the OFF state according to setpoint information received by the control circuit from a receiver connected to the receiver line.

According to a major aspect of the invention, the microprocessor circuitry is programmed to produce an audible feedback signal without a conventional acoustic transducer. It does so by cycling the drive circuit between the ON state and the OFF state under program control at an audible rate for a controlled period of time at a duty ratio sufficiently small to avoid normal motor operation so that current flowing from the battery during the ON state causes audibly discernible mechanical vibration of at least one of the drive circuit, battery componentry connected to the first and second battery lines (i.e., a battery and associated wiring), and motor componentry connected to the motor line (i.e., a motor and associated wiring). The microprocessor circuitry may also be programmed to turn a brake circuit on while cycling the drive circuit in order to insure a path for current to flow apart from the motor so that current can flow even if the motor is disconnected.

In line with the above, a method of producing an audible signal for speed controller feedback purposes includes the step of providing a speed controller having a drive circuit and microprocessor circuitry as just described. The method proceeds by cycling the drive circuit between the ON state and the OFF state at an audible rate and a duty ratio sufficiently small to avoid normal motor operation. The method may also include the step of turning the brake circuit on.

The following detailed description and illustrative drawings make the foregoing and other objects, features, and advantages of the invention more apparent.

DESCRIPTION OF THE PREFERRED EMBODIMENTS

Figure 1:
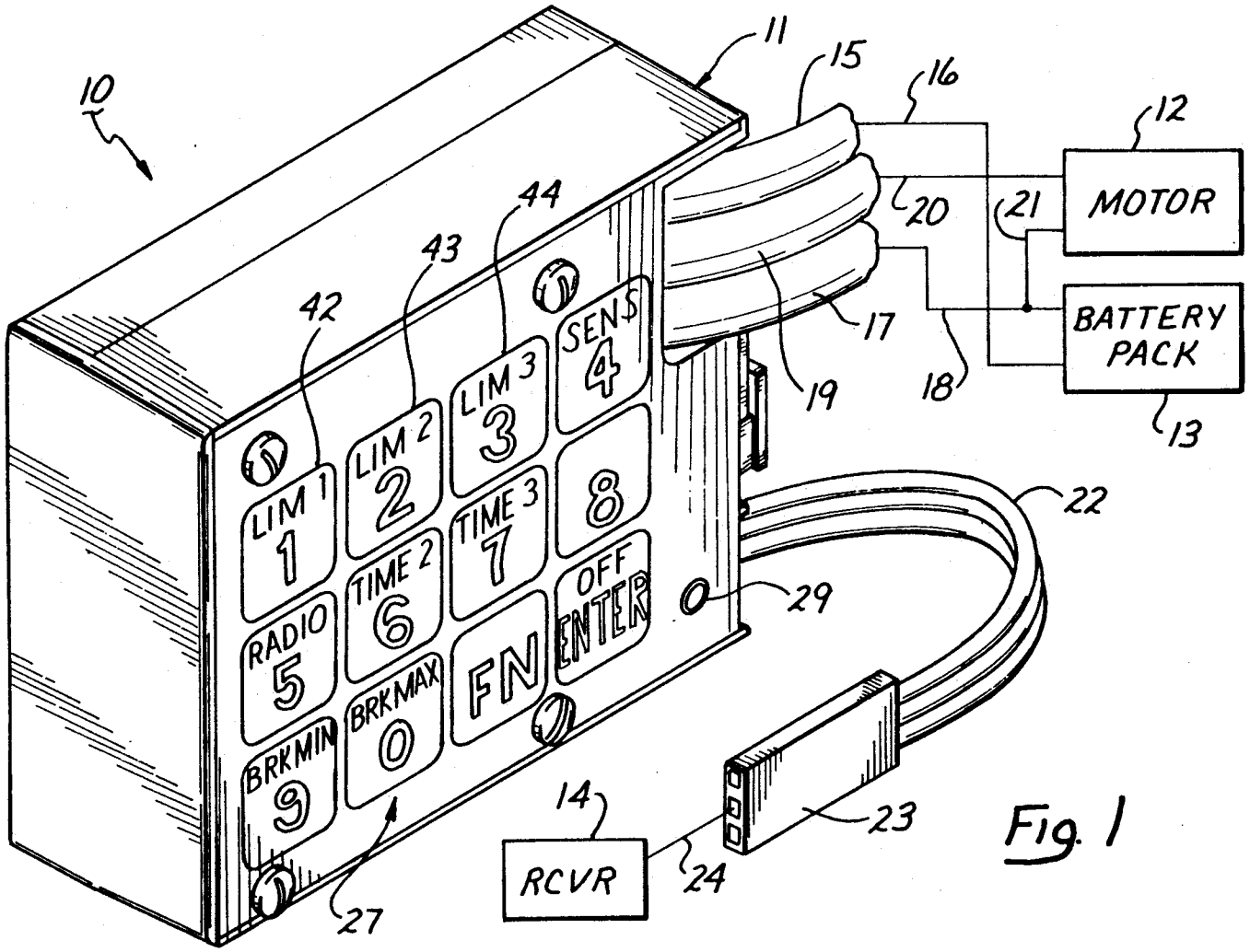
FIG. 1 of the drawings is a pictorial of an R/C speed controller constructed according to the invention.

FIG. 1 of the drawings shows one version of a R/C speed controller 10 constructed according to the invention. Generally, it includes a module 11 (a housing) that houses and supports control circuitry. The module 11 is suitably small to be mounted on a conventional radio controlled model (e.g., it may measure about 4.0 cm by 3.5 cm by 1.5 cm) and the control circuitry is miniaturized sufficiently to fit on the module 11 (the term "on" also meaning "within" the module 11). The module 11 may mount on the model by known means (e.g., double-backed adhesive tape or screws) and it serves the function of housing and supporting the various electronic circuit components of the speed controller circuitry that are subsequently described in further detail with reference to FIG. 2.

Suitable wiring electrically connects the control circuitry to a motor 12, a battery 13, and a receiver 14 on the radio controlled model (FIG. 1). A wire 15 connects the control circuitry to one terminal of the battery 13 as depicted by a line 16. A wire 17 connects it to the other terminal of the battery 13 as depicted by a line 18. A wire 19 connects it to one terminal of the motor 12 as depicted by a line 20, and the other terminal of the motor 12 is connected to the same terminal of the battery 13 as depicted by a line 21.

In addition, a three-wire cable 22 terminating in a connector 23 connects the control circuitry to the receiver 14 as depicted by a line 24. Two wires in the cable provide battery power to the receiver 14 while the third wire couples a signal from the receiver 14 to the control circuitry. Of course, the wires 15, 17, and 19 may also include connectors, but some operators find it advantageous to solder those wires directly to terminals on the motor 12 and battery 13 for better conductivity and thereby better efficiency.

Figure 2:
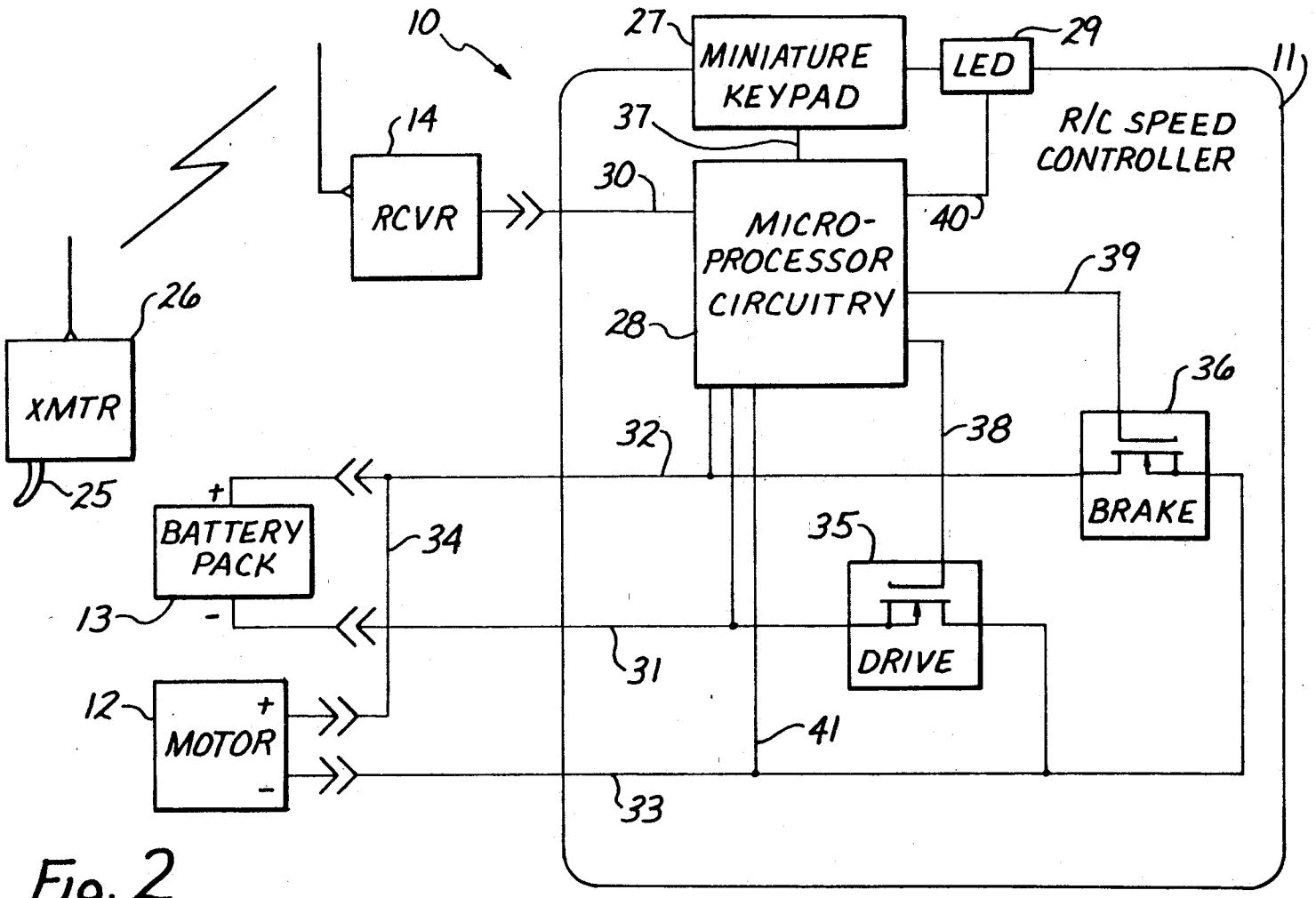
FIG. 2 is a block circuit diagram of the speed controller connected to a motor, a battery pack, and a receiver for operation in an R/C model car.

The speed controller 10 operates conventionally in some respects in the sense that it couples power from the battery 13 to the motor 12 according to setpoint information received by the receiver 14. That enables an operator to remotely control a model in which the controller 10 is installed by manipulating throttle trigger 25 or other setpoint input device on a conventional handheld transmitter unit 26 (FIG. 2). Doing so causes the transmitter unit 26 to transmit setpoint information to the speed controller 10 via the onboard receiver 14 and that results in the speed controller 10 controlling the motor 12 accordingly.

But unlike existing R/C speed controllers, the speed controller 10 includes a keypad 27 mounted on the module 11 (FIGS. 1 and 2). It combines with microprocessor circuitry 28 (FIG. 2) to facilitate operation by enabling convenient and repeatable direct entry of various operating parameters without the need to fine tuning potentiometers. As a part of that operation, the speed controller 10 produces a visually discernible feedback signal with a light emitting diode illustrated as an LED 29 (FIGS. 1 and 2). According to a major aspect of the invention, the speed controller 10 also produces an audibly discernible feedback signal without using a conventional acoustic transducer by producing audible mechanical vibrations with high current pulses.

To see how that is done, consider the control circuitry in FIG. 2. It includes a receiver line 30 (connected to the third wire in the cable 22 of FIG. 1), first and second battery lines 31 and 32 (connected to the wires 15 and 17 in FIG. 1), and a motor line 33 (connected to the wire 19 in FIG. 1). Those are electrically conductive lines and they connect to the receiver 14, the motor 12, and the battery 13 by means of the wiring shown in FIG. 1 (e.g., with connectors or soldering). The receiver line 30 connects in a conventional manner to a control-signal output of the receiver 14 over which setpoint information is sent to the control circuitry. The first and second battery lines 31 and 32 connect to first and second terminals of the battery 13, and the motor line 33 connects to a first terminal of the motor 12. A line 34 connects the second terminal of the motor 12 to the second terminal of the battery 13 (directly or by connection to the second battery line 32).

Figure 3:
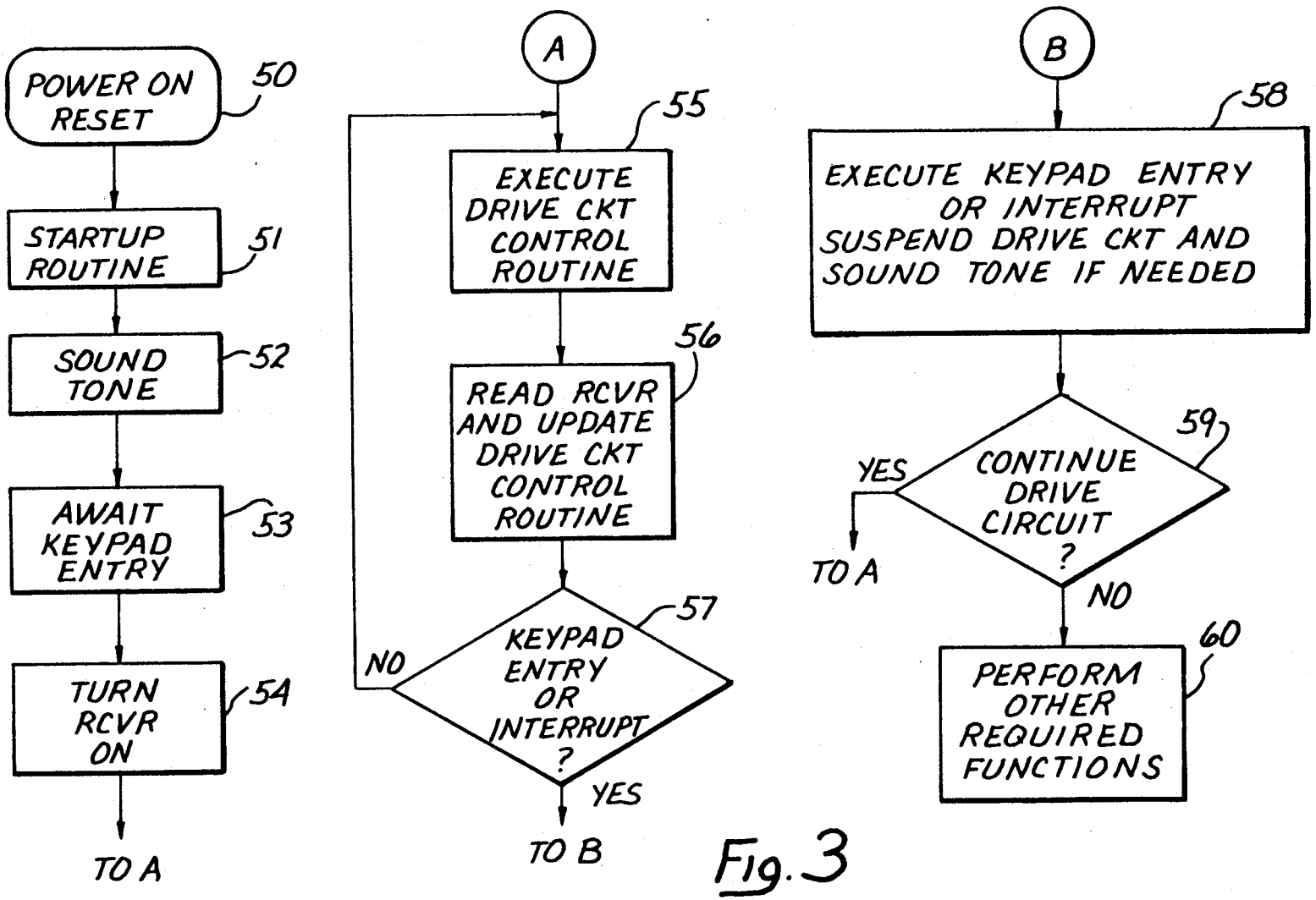
FIG. 3 is a high level flow chart of the programming employed.

The control circuitry also includes a drive circuit 35 and a brake circuit 36 (FIG. 3). The drive circuit 35 is connected between the first battery line 31 and the motor line 33. There, it controls the flow of current between the battery 13 and the motor 12 by providing a switchable low impedance path. It switches under control of the microprocessor circuitry 28 between an ON state in which it couples the first battery line 31 to the motor line 33 and an OFF state in which it decouples the first battery line 31 from the motor line 33. Although the illustrated embodiment includes a drive circuit in the negative lead, it is within the inventive concepts disclosed to control the positive lead instead.

The brake circuit 26 is connected between the motor line 33 and the second battery line 32. There, it facilitates deceleration of the motor 12 by providing a switchable low impedance path for flyback current. It switches under control of the microprocessor circuitry 28 between a first brake circuit state in which it couples the motor line 33 to the second battery line 32 and a second brake circuit state in which it decouples the second battery line 32 from the motor line 33. The brake circuit 36 may be omitted for some applications (e.g., in model aircraft R/C controllers).

The microprocessor circuitry 28 is coupled to the first and second battery lines 31 and 31 for power. It is coupled to the receiver line 30 for receiving the setpoint information, and it is coupled by a line 37 to the keypad 27 in order to respond to keypad entries. A control line 38 couples a drive circuit control signal from the microprocessor circuitry 37 to the drive circuit 35, a control line 39 couples a brake circuit control signal to the brake circuit 36, and a control line 40 couples power under microprocessor control to the LED 29. In addition, a line 41 connects the motor line 33 to the microprocessor circuitry 28 so that the microprocessor can monitor the voltage on that line.

Interconnected that way, the microprocessor circuitry 28 performs the function of switching the drive circuit and the brake circuit under program control according to setpoint information received on the receiver line 30. For that purpose, the microprocessor circuitry 28 includes suitable digital circuitry (e.g., a microprocessor or microcontroller and known associated componentry). It may include, for example, a central processor, memory, input and output circuitry, power supply components, a clock, an analog-to-digital converter, and any of other various known analog and digital components configured according to known techniques to perform as subsequently described. In addition, it includes programming configured according to known programming techniques to perform as described.

The individual components and the precise programming employed in the illustrated embodiment are not specified in further detail. Those things are well within the capabilities of one of reasonable skill in the art based upon the descriptions provided. The precise configuration may vary significantly according to individual preferences. By way of example, however, the microprocessor circuitry 28 may include the microcontroller chip available from Motorola that is identified by part number 68HC705P9, as well as known associated componentry, and it may be programmed using known techniques.

The line 38 couples the drive circuit control signal from the microprocessor circuitry 28 to the drive circuit 35, and the line 39 couples the brake circuit control signal from the microprocessor circuitry 28 to the brake circuit 36. The microprocessor circuitry 26 is programmed to produce the drive circuit control signal and the brake circuit control signal according to setpoint information received on the receiver line 30 in order to switch the drive circuit 35 and the brake circuit 36 at the appropriate times to cause the motor 12 to operate as desired.

According to a major aspect of the invention, the microprocessor circuitry 28 is programmed to produce an audible feedback signal by cycling the drive circuit between the ON state and the OFF state at an audible rate and a duty ratio sufficiently small to avoid normal motor operation. To accomplish that, it produces a drive circuit control signal on the line 38 with suitable timing. It does so for a controlled period of time so that current flowing through the drive circuit 35 causes audibly discernible mechanical vibration of at least one of the drive circuit 35, battery componentry connected to the first and second battery lines (i.e., the battery 13 and associated wiring), and motor componentry connected to the second battery line and the motor line (i.e., the motor 12 and associated wiring) as an audible feedback signal. Varying the controlled period of time and switching frequency produces musical notes, chimes, and so forth that signify various events, such as turnon, turnoff, initialization, keypad entries, and so forth.

To further appreciate the technique employed, recall that the microprocessor circuitry 28 is programmed to produce normal motor operation in response to setpoint information received from the receiver 14. The setpoint information reflects the position of the throttle trigger 25 to indicate desired motor speed and braking action. It varies over a range extending from a high brake circuit endpoint value (throttle trigger pushed fully forward for maximum braking) to a high drive circuit endpoint value (throttle trigger pulled fully rearward for maximum motor speed). Intermediate those endpoints is a neutral setpoint corresponding to the throttle trigger 25 being in a neutral position intermediate the fully forward and fully rearward position (the throttle trigger 25 is spring biased in that neutral position).

To produce normal motor operation, the microprocessor circuitry 28 cycles the drive circuit 35 between the ON state and the OFF state in a series of cycles at a predetermined rate (e.g., 3 KHz) and a duty ratio corresponding to the setpoint information. The duty ratio for a particular cycle is the ratio of time the drive circuit 35 is in the ON state to the sum of that time and the time it is in the OFF state. When the operator pulls the throttle trigger 25 rearwardly from the neutral position just enough to vary the setpoint a predetermined incremental amount (e.g., 6% of the distance between the neutral and the fully rearward positions), the microprocessor circuitry 28 cycles the drive circuit at a low end drive circuit duty ratio of six percent (corresponding to about 20 microseconds in the ON state). The microprocessor circuitry 28 ignores the first six percent of throttle trigger movement because a drive circuit duty ratio below six percent does not normally produce sufficient torque in the motor. As the throttle trigger 25 is pulled further rearwardly to the fully rearward position, the microprocessor circuitry 28 increases the duty ratio accordingly, to a maximum of one hundred percent for the fully rearward position (drive circuit continually in the ON state). Normal motor operation (i.e., sufficient torque to drive the model car wheels) occurs between those points.

To produce an audible signal for feedback purposes, the microprocessor circuitry 28 cycles the drive circuit 35 between the ON state and the OFF state without regard to the setpoint information. It does so at an audible rate and a duty ratio sufficiently small to avoid much, if any, normal motor operation. For that purpose, the duty ratio is preferably set below 6% (less than 20 microseconds in the ON state) and the switching rate is set at other than 3 KHz (e.g., 500–2,000 Hz). Of course, the duty ratio may be set somewhat higher for feedback signal purposes within the inventive concepts disclosed (e.g., 9–10%), although a small (but tolerable) amount of motor operation may then result.

As the drive circuit is cycled that way, 30–50 ampere current pulses flowing during the ON state. That is sufficient to cause audibly discernible mechanical vibration of various circuit components, including at least one of the motor armature, motor wiring, battery wiring, and land patterns on a circuit board on which the control circuitry is mounted. The drive circuit 35 is cycled for a controlled period of time (e.g., one-half second for a beep and longer for various musical notes, chimes, and so forth). Varying the rate varies the tone of the feedback signal, varying the period of time the drive circuit 35 is in the ON state varies the intensity, and the microprocessor circuitry 28 is programmed to vary those parameters to produce a desired audible feedback signal.

One way the speed controller 10 uses the audible feedback signal is to signify successful completion of an initializing sequence undertaken when power is first applied. The microprocessor circuitry 28 is suitable arranged, interconnected, and programmed to perform the initializing sequence when the operator first connects the battery 13 to the speed controller 10. In other words, the microprocessor circuitry 28 starts up automatically, and in the process it initializes various program parameters. Once that is completed successfully, the microprocessor circuitry 28 produces an audible feedback signal. That way, the operator knows that transients or other disturbances during battery connection have not defeated the initializing sequence.

Another way the speed controller 10 uses the audible feedback signal is to signify successful keypad entries. The keypad 27 includes at least three keys (such as those designated keys 42–44 in FIG. 1) and preferably the twelve keys illustrated. The microprocessor circuitry 28 is programmed to produce an audible signal when anyone of the keys is depressed to signify a successful keypad entry. Of course, the microprocessor circuitry 28 may be programmed to produce an audible feedback signal signifying any of various other events.

Considering the brake circuit in further detail, it provides a path for current flow in the absence of the motor 12. For that purpose, the microprocessor circuitry 28 is programmed to switch the brake circuit to the first brake circuit state during the controlled period of time it cycles the drive circuit for feedback signal generation purposes. Further details of construction and operation follow.

Miniature Keypad. With further regard to the keypad 27, it is part of the microprocessor circuitry 28 and occupies an accessible position on the module 11 so that an operator can input information by depressing various keys. Of course, the keypad 27 can be a separate component that connects to the module 11 during keypad use without departing from the invention. An operator depresses various ones of the keys to input information to the microprocessor circuitry 28, such as setup and operating parameters.

As an example of keyboard construction, the keypad 27 may take the form of a clear plastic membrane (such as the material available under the trademark MYLAR) on which the various indicia shown in FIG. 1 are printed. The membrane includes a conductive silver ink printed on the reverse side (the side facing away from the operator). When a key is depressed, the silver ink contacts two printed circuit board traces associated with the particular key that was depressed. That shorts the two traces together so that they function as the two contacts of a single-pole-single-throw switch for that particular key. Of course, other keypad arrangements may be employed within the inventive concept disclosed of outfitting an R/C speed controller with a keypad and microprocessor circuitry in order to significantly facilitate operation.

Drive Circuit. The drive circuit 35 includes one or more semiconductor devices capable of switching the current supplied by the battery 13 to the motor 12. It may use, for example, a bank of several parallel-connected MOSFET devices, such as those available from Siliconix that are identified by part number SMP60N05.

The drive circuit 35 is conventional is some respects in the sense that it operates to switch current flowing between the battery 13 and the motor 12. It does so under program control, however, and according to information inputted with the keypad 27. It switches the drive circuit 35 under program control to cause pulses of current of desired duration and repetition rate to flow to the motor 12. The microprocessor circuitry 28 varies the duration and repetition rate to achieve the desired current flow. In that way, it controls the flow of battery power to the motor 12 and thereby controls motor operation accordingly. In addition, it enables other inventive functions to be accomplished.

Brake Circuit. The brake circuit 36 includes one or more semiconductor devices for shorting the motor terminals together for braking purposes. They are capable of switching the amount of current that flows. The illustrated brake circuit 36 employs two parallel-connected MOSFET devices, such as the Siliconix SMP60N05 devices previously described for the drive circuit 35.

The brake circuit 36 is conventional in some respects in that it operates to decelerate the motor 12. It provides a switchable low impedance path between the motor terminals. However, it does so under program control. The microprocessor circuitry 28 switches the brake circuit 36 to the first brake circuit state to load the motor 12 and thereby decelerate it. In the absence of the low impedance path provided by the brake circuit 36, the motor 12 freewheels when the drive circuit 35 is in the OFF state and only coasts to a stop.

Programming. FIG. 3 is a high level flow chart of the programming employed. When a battery pack is connected to the speed controller 10, the microprocessor circuitry resets at block 50 and goes to a startup routine (an initialization routine) at 51 in which it sets various program parameters, flags, and so forth. After initialization, the programming sounds a tone at 52 in the manner previously described to signify successful completion of the initialization routine. Then, it loops at 53 while awaiting a keypad entry.

When a keypad entry is detected at 53, the programming turns on the receiver at 54 and executes a drive circuit control routine at 55. The drive circuit control routine turns the drive circuit on and off according to setpoint information received from the receiver. The programming reads the setpoint information at 56 and updates the drive circuit control routine. That way, the updated setpoint information applies the next time the drive circuit control routine is executed. Changes in the setpoint information may occur every ten milliseconds or so.

The programming then checks for a keypad entry or an interrupt. If there are none, it re-executes the drive circuit control routine according to the updated setpoint information. If a keypad entry or an interrupt is detected, the programming executes according to the keypad entry or interrupt at 58. As a part of that routine, it suspends drive circuit operation and sounds a tone to signify that a keypad entry has been made and to signify various operations in the interrupt routines.

Once the keypad entry or interrupt has been serviced, the programming determines at 59 whether to continue drive circuit operation. That decision may depend on the keypad entry or interrupt. If yes, the programming goes back to the drive circuit control routine at 55. If no, it performs other functions, such as setting new operating parameters according to a keypad entry just serviced, turning off the receiver, and so forth.

Operation. Operation involves connecting the battery 13. When that is done, the speed controller 10 performs the initializing sequence previously described and produces a tone (i.e., a feedback signal). Then, the operator makes keypad entries using the keypad 27 to set various operating parameters. Although key layout and operation may take any of various forms within the broader inventive concepts disclosed, the layout shown in FIG. 1 combines with inventive programming to provide significant functionality in speed controller 10.

The LIM 1, LIM 2, and LIM 3 keys input desired limits on the current supplied by the battery 13 (from 0 to 9999 amperes). They also input the digits "1,""2," and "3." The LIM 1 value applies at the start of operations. The LIM 2 and LIM 3 limits apply the number of seconds after the start of operations entered with the TIME 2 and TIME 3 keys. The TIME 2 and TIME 3 keys are also used to input the digits "6" and "7."

The SENS key inputs throttle sensitivity information and the digit "4." The RADIO key is used for calibrating the receiver 14 (i.e., causing the microprocessor circuitry 28 to adjust to the characteristics of the receiver 14 and transmitter 26) and for inputting the digit "5." In that regard, existing R/C transmitter units usually use control information encoded on a carrier by pulse width modulation. A pulse width of one millisecond typically represents a full brake position of the throttle 22 and a pulse width of two milliseconds represents a full throttle position. The RADIO key enables an operator to adjust the microprocessor circuitry 28 to the characteristics of the command signal from the receiver 14 and transmitter 26 regarding the full brake and full throttle positions.

The 8 key inputs the digit "8." The BRK MIN and BRK MAX keys input braking characteristics information and the digits "9" and "0." The FN key selects the function mode so that the next key depressed will specify its function rather than a digit, and the OFF ENTER key serves to enter the information represented by the keys depressed. It also serves to turn off various circuits.

To calibrate the receiver 14, the operator turns the transmitter 26 on and presses the FN key followed by the RADIO key. Next, the operator moves the throttle 25 on the transmitter 26 between the maximum throttle and maximum brake positions a couple of times and leaves it in the neutral position. Then the operator presses the OFF ENTER key.

To set a current limit, press the FN key followed by the LIM 1, LIM 2, or LIM 3 key. Next, enter the desired current limit between 0 and 9999 amperes by depressing the appropriate keys. Then press the OFF ENTER key. To set the time the second or third limit is to apply, press the FN key followed by the TIME 2 or the TIME 3 key. Next, enter the desired time in seconds by depressing the appropriate keys. Then press the OFF ENTER key.

The microprocessor circuitry 26 considers the race start to be the instant the throttle 22 is moved to the full throttle position for the first time after the speed controller 10 has been reset. The microprocessor circuitry 26 bases all timing on that start point. Turning the speed controller 10 on or changing the current limits or times also resets the speed controller 10. The OFF ENTER key can be depressed at the end of a race to turn the speed controller 10 off.

Thus, the invention cycles drive current on and off at an audible rate for a controlled period of time to produce audibly discernible mechanical vibration of various componentry. Musical notes, chimes, and so forth communicate audibly with the operator to signify turnon, turnoff, initialization, keypad entries, and various other events, thereby enhancing speed controller operation while avoiding the space, weight, and cost of conventional transducer componentry. Although an exemplary embodiment has been shown and described, one of ordinary skill in the art may make many changes, modifications, and substitutions without necessarily departing from the spirit and scope of the invention.

What is claimed is:

1. A method of producing an audible signal for speed controller feedback purposes, the method comprising:

providing a speed controller having a receiver line, first and second battery lines, a motor line, means in the form of a drive circuit connected between the first battery line and the motor line for switching between an ON state in which the drive circuit couples the first battery line to the motor line and an OFF state in which the drive circuit decouples the first battery line from the motor line, and means in the form of a microprocessor circuitry connected to the receiver line and the drive circuit for switching the drive circuit under program control between the ON state and the OFF state according to setpoint information received by the microprocessor circuitry from a receiver connected to the receiver line; and cycling the drive circuit under program control between the ON state and the OFF state at an audible rate for a controlled period of time at a duty ratio sufficiently small to avoid significant normal motor operation so that current flowing through the drive circuit causes audibly discernible mechanical vibration of at least one of the drive circuit, battery componentry connected to the first and second battery lines, and motor componentry connected to the motor line.

2. A method as recited in claim 1, wherein:

the speed controller includes means in the form of a brake circuit connected between the second battery line and the motor line for switching between a first brake circuit state in which the brake circuit couples the second battery line to the motor line and a second brake circuit state in which the brake circuit decouples the second battery line from the motor line; and the step of cycling the drive circuit under program control includes switching the brake circuit to the first brake state while cycling the drive circuit in order to provide a path for current to flow apart from motor componentry connected to the motor line so that current can flow and cause audibly discernible vibrations even if motor componentry is not connected.

3. A speed controller for a radio controlled model, comprising:

a receiver line, first and second battery lines, and a motor line;

means in the form of a drive circuit connected between the first battery line and the motor line for switching between an ON state in which the drive circuit couples the first battery line to the motor line and an OFF state in which the drive circuit decouples the first battery line from the motor line; and means in the form of microprocessor circuitry connected to the receiver line and the drive circuit for switching the drive circuit under program control between the ON state and the OFF state according to setpoint information received by the control circuit from a receiver connected to the receiver line;

the microprocessor circuitry being programmed to produce an audible feedback signal by cycling the drive circuit between the ON state and the OFF state at an audible rate for a controlled period of time at a duty ratio sufficiently small to avoid significant normal motor operation so that current flowing through the drive circuit causes audibly discernible mechanical vibration of at least one of the drive circuit, battery componentry connected to the first and second battery lines, and motor componentry connected to the second battery line and the motor line.

4. A speed controller as recited in claim 3, wherein:

the speed controller includes means in the form of a brake circuit connected between the second battery line and the motor line for switching between a first brake circuit state in which the brake circuit couples the second battery line to the motor line and a second brake circuit state in which the brake circuit decouples the second battery line from the motor line;

the microprocessor circuitry is connected to the brake circuit in order to switching the brake circuit under program control between the first brake circuit state and the second brake circuit state; and the microprocessor circuitry is programmed to switch the brake circuit to the first brake state while cycling the drive circuit in order to provide a path for current to flow apart from motor componentry so that current can flow and cause audibly discernible mechanical vibration even if motor componentry is not connected.

5. A speed controller as recited in claim 3, wherein the microprocessor circuitry is programmed to:

perform an initializing sequence when a battery is connected to the first and second battery lines; and produce an audible signal to signify completion of the initializing sequence.

6. A speed controller as recited in claim 3, wherein:

the microprocessor circuitry includes means in the form of a keypad for enabling an operator to make keypad entries; and the microprocessor circuitry is programmed to produce an audible signal to signify a keypad entry.

7. A speed controller as recited in claim 6, wherein the keypad includes at least three keys.

8. A speed controller, comprising:

means in the form of a module for housing various electronic circuit components and supporting them on a radio controlled model; and means in the form of speed controller circuitry on the module for controlling the flow of current between a battery and a motor according to setpoint information received from a receiver;

the speed controller circuitry having first and second battery lines, a motor line, and means in the form of microprocessor circuitry for switching the speed controller circuitry under program control between an ON state in which the speed controller circuitry couples the first battery line to the motor line and an OFF state in which the speed controller circuitry decouples the first battery line from the motor line; and the microprocessor circuitry being programmed to produce an audible signal without a conventional acoustic transducer device by switching between the ON state and the OFF state at an audible rate for a controlled period of time at a duty ratio sufficiently small to avoid normal motor operation so that a resulting current flow causes audible mechanical vibration of at least one of the speed controller circuitry, battery componentry connected to the first and second battery lines, and motor componentry connected to the second battery line and the motor line.

* * * * *